US006415958B1

(12) United States Patent
Donley

(10) Patent No.: US 6,415,958 B1
(45) Date of Patent: Jul. 9, 2002

(54) NEEDLE VALVE ACTUATOR FOR HOT MELT ADHESIVE HAND APPLICATOR AND A METHOD FOR OPERATING THE SAME

(75) Inventor: Paul J. Donley, Hendersonville, TN (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/036,459

(22) Filed: Jan. 7, 2002

(51) Int. Cl.[7] ..... B67D 5/62
(52) U.S. Cl. ..... 222/146.5
(58) Field of Search ..... 222/144.5, 146.2, 222/146.6; 239/132–135, 525, 526

(56) References Cited

U.S. PATENT DOCUMENTS 3,118,610 A * 1/1964 Techler ..... 222/146.5
3,885,739 A * 5/1975 Tuttle ..... 222/146.5
3,971,492 A 7/1976 Lockwood
4,176,793 A * 12/1979 Heinrich ..... 222/144.5
4,245,759 A 1/1981 Baker et al.
5,803,313 A * 9/1998 Flatt et al. ..... 222/146.5

* cited by examiner

*Primary Examiner*—Philippe Derakshani
*Assistant Examiner*—Thach H. Bui
(74) *Attorney, Agent, or Firm*—Schwartz & Weinrieb

(57) ABSTRACT

A hot melt adhesive dispensing gun has a needle valve movably mounted within a dispensing nozzle provided with a discharge port from which hot melt adhesive material can be dispensed, wherein the needle valve is normally seated upon a valve seat. An electrical switch mechanism is mounted upon the dispensing gun for controlling the activation of an adhesive material supply pump as well as a solenoid air valve for controlling the supply of swirl air in conjunction with the supply and dispensing of the hot melt adhesive material. A trigger member is operatively connected to the electrical switch mechanism and the needle valve such that when the trigger member is actuated or squeezed, the electrical switch mechanism is CLOSED prior to the unseating of the valve member from its valve seat so as to ensure a sufficient supply of hot melt adhesive material and swirl air to the dispensing nozzle prior to the actual dispensing of the hot melt adhesive material from the discharge port.

20 Claims, 8 Drawing Sheets

NEEDLE VALVE ACTUATOR FOR HOT MELT ADHESIVE HAND APPLICATOR AND A METHOD FOR OPERATING THE SAME

CROSS-REFERENCE TO RELATED PATENT APPLICATIONS

This patent application is related to U.S. patent application Ser. No. 09/947,476 filed on Sep. 7, 2001 in the name of Christopher D. Bryan et al. and entitled HOT MELT ADHESIVE HAND APPLICATOR.

FIELD OF THE INVENTION

The present invention relates generally to hot melt adhesive hand applicators or applicator guns, and more particularly to a new and improved hot melt adhesive hand applicator or applicator gun, and a method of operating the same, wherein the trigger mechanism thereof is interconnected to the needle valve member of the applicator or gun such that when the trigger mechanism of the applicator or gun is squeezed or pulled, a substantially two-part or two-step actuation-type mode of operation is effectively achieved whereby in accordance with a first part or first step of the actuation operation, an electrical switch is initially moved from its OPENED state to its CLOSED state so as to provide power to, for example, a rotary gear pump by means of which adhesive material may be supplied to the applicator or gun under pressure, and simultaneously therewith, electrical power is also provided to a solenoid air valve by means of which pressurized air can be supplied to the nozzle assembly of the applicator or gun in a swirl application mode for interaction with the adhesive material, while in accordance with a subsequent, second part or second step of the actuation operation, the needle valve member is moved axially so as to be effectively lifted from its CLOSED position upon its valve seat to an OPENED position away from the valve seat so as to permit the dispensing of the adhesive material.

BACKGROUND OF THE INVENTION

Hot melt adhesive applicators usually have a configuration which is similar to that of a gun, and accordingly comprises, for example, an upper, horizontally disposed body portion at the free end tip of which there is provided a nozzle member from which the hot melt adhesive material is dispensed, and an integrally connected, vertically oriented handle portion upon which a suitable trigger mechanism is operatively mounted. As disclosed within the aforenoted patent application, the trigger mechanism is utilized to actuate both the needle valve member of the needle valve assembly, as well as an electrical switch assembly which, in turn, is utilized to activate both an adhesive material supply gear pump and a solenoid air valve component of a compressed air supply assembly for supplying compressed air to be utilized in conjunction with the adhesive material being dispensed. In connection with the aforenoted interrelated arrangement of the various structural components comprising the adhesive applicator or gun, it is particularly desirable that the trigger mechanism actuates the electrical switch assembly prior to the actuation of the needle valve assembly such that, when the needle valve assembly is in fact actuated so as to move the needle valve member from its CLOSED position with respect to its valve seat to its OPENED position with respect to its valve seat, a sufficient supply of adhesive material will have already been supplied to the needle valve assembly so as to ensure the dispensing of a proper volume of adhesive material in order to achieve predetermined adhesive material dispensing patterns, and in addition, a sufficient supply of compressed air will likewise have already been supplied within the vicinity of the dispensing nozzle for use in conjunction with the dispensing of the adhesive material so as to ensure the properly controlled dispensing of the adhesive material in accordance with conventionally known swirl air patterns. Such an actuation sequence in connection with the operation or actuation of the needle valve member and the electrical switch assembly has not been heretofore achieved.

Accordingly, a need therefore exists in the art for a new and improved structural arrangement of the various operative components of the hot melt adhesive material applicator gun wherein the trigger mechanism can actuate the electrical switch assembly prior to the actuation of the needle valve assembly such that, when the needle valve assembly is in fact actuated so as to move the needle valve member from its CLOSED position with respect to its valve seat to its OPENED position with respect to its valve seat, a sufficient supply of adhesive material will have already been supplied to the needle valve assembly so as to ensure the dispensing of a proper volume of adhesive material in order to achieve predetermined adhesive material dispensing patterns, and in addition, a sufficient supply of compressed air will likewise have already been supplied within the vicinity of the dispensing nozzle for use in conjunction with the dispensing of the adhesive material so as to ensure the properly controlled dispensing of the adhesive material in accordance with conventionally known swirl air patterns.

OBJECTS OF THE INVENTION

Accordingly, it is an object of the present invention to provide a new and improved hot melt adhesive applicator gun and a method of operating the same.

Another object of the present invention is to provide a new and improved hot melt adhesive applicator gun, and a method of operating the same, which overcomes the various operational drawbacks and disadvantages characteristic of PRIOR ART hot melt adhesive applicator guns.

An additional object of the present invention is to provide a new and improved hot melt adhesive applicator gun, and a method of operating the same, wherein the needle valve member of the needle valve assembly, and the electrical switch assembly for controlling the activation of an adhesive material supply gear pump as well as for controlling the activation of a solenoid air valve component of a compressed air supply assembly for supplying compressed air to be utilized in conjunction with the adhesive material being dispensed, is properly sequenced.

A further object of the present invention is to provide a new and improved hot melt adhesive applicator gun, and a method of operating the same, wherein the electrical switch assembly, for controlling the activation of an adhesive material supply gear pump as well as for controlling the activation of a solenoid air valve component of a compressed air supply assembly for supplying compressed air to be utilized in conjunction with the adhesive material being dispensed, is actuated prior to the actuation of the needle valve member of the needle valve assembly.

A last object of the present invention is to provide a new and improved hot melt adhesive applicator gun, and a method of operating the same, wherein the electrical switch assembly, for controlling the activation of an adhesive material supply gear pump as well as for controlling the activation of a solenoid air valve component of a compressed air supply assembly for supplying compressed air to be utilized in conjunction with the adhesive material being dispensed, is actuated prior to the actuation of the needle valve member of the needle valve assembly whereby a sufficient supply of adhesive material will have already been supplied to the needle valve assembly, so as to ensure the dispensing of a proper volume of adhesive material in order to achieve predetermined adhesive material dispensing patterns, and in addition, a sufficient supply of compressed air will likewise have already been supplied, within the vicinity of the dispensing nozzle for use in conjunction with the dispensing of the adhesive material, so as to ensure the properly controlled dispensing of the adhesive material in accordance with conventionally known swirl air patterns.

SUMMARY OF THE INVENTION

The foregoing and other objectives are achieved in accordance with the teachings and principles of the present invention through the provision of a new and improved hot melt adhesive material applicator gun, and a method of operating the same, which comprises a trigger mechanism which is interconnected to the needle valve member of the applicator or gun such that when the trigger mechanism of the applicator or gun is squeezed or pulled, a substantially two-part or two-step actuation-type mode of operation is effectively achieved. In accordance with a first part or first step of the actuation operation, an electrical switch is initially moved from its OPENED state to its CLOSED state so as to provide power to, for example, a rotary gear pump by means of which adhesive material can be supplied to the applicator gun under pressure, and simultaneously therewith, electrical power is also provided to a solenoid air valve by means of which pressurized air can be supplied to the nozzle assembly of the applicator gun in a swirl application mode for interaction with the adhesive material, while in accordance with a subsequent, second part or second step of the actuation operation, the needle valve member is moved axially so as to be effectively lifted from its CLOSED position upon its valve seat to an OPENED position away from the valve seat so as to permit the dispensing of the adhesive material. In this manner, a sufficient supply of the adhesive material, and a sufficient supply of the swirl control air, is provided prior to the actual dispensing of the adhesive material so as to ensure the proper dispensing of the adhesive material in accordance with desired dispensing patterns.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
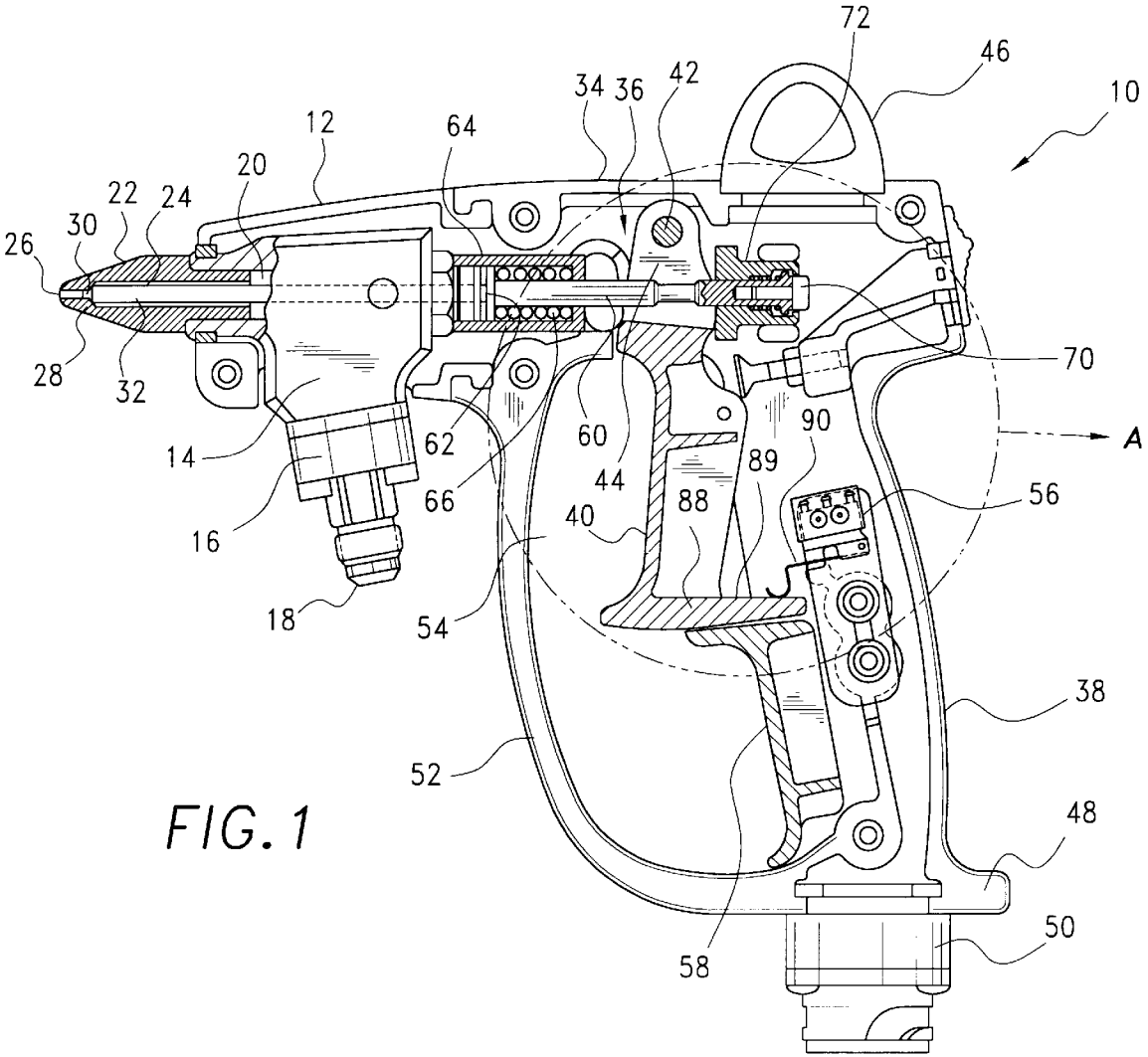
FIG. 1 is side elevational view, partially in cross-section, of a new and improved hot melt adhesive material applicator gun having the new and improved trigger mechanism assembly, constructed in accordance with the principles and teachings of the present invention, incorporated therein wherein the trigger member is illustrated in its relaxed, non-actuated state and the needle valve member is disposed upon the needle valve seat.

Referring now to the drawings, and more particularly to FIG. 1 thereof, the new and improved hot melt adhesive applicator gun, as constructed in accordance with the principles and teachings of the present invention, is disclosed and is generally indicated by the reference character 10. The upper forward end portion of the applicator gun 10 comprises a heater body housing 12 within which a heater body member 14 is disposed, and the heater body member 14 has a stem fitting housing 16 operatively associated therewith. The stem fitting housing 16 has a stem or connector member 18 mounted therein, and the stem or connector member 18 is adapted to be operatively connected to a hydraulic material supply hose, not shown, by means of which hydraulic or adhesive material is supplied to the applicator gun 10. The stem or connector member 18 has a bore, not shown, defined therein through means of which the hydraulic or adhesive material is introduced into the heater body member 14, and the heater body member 14 is likewise provided with an axially oriented bore 20 which is adapted to be fluidically connected to the bore, not shown, of the stem or connector member 18 in order to receive the hydraulic or adhesive material being introduced therethrough.

An applicator nozzle 22 is mounted upon or within a forward end portion of the heater body member 14, and it is seen that the applicator nozzle 22 also has an axially oriented bore 24 which is coaxially arranged with, and is adapted to be fluidically connected to, the axially oriented bore 20 of the heater body member 14. The forwardmost tip portion of the applicator nozzle 22 is provided with a discharge port 26 from which the adhesive material can be dispensed, and it is seen that the discharge port 26 is separated from its axially oriented bore 24 by means of a tapered shoulder portion 28 which effectively forms a valve seat for the tip portion 30 of a needle valve member 32. Consequently, as may be readily appreciated, when the needle valve member 32 is disposed at its forward, extended position, the tip portion 30 thereof is seated upon the valve seat portion 28 of the applicator nozzle 22 whereby dispensing of adhesive material from the discharge port 26 of the applicator nozzle 22 does not occur, whereas when the needle valve member 32 is disposed at a rearward, retracted position, the tip portion 30 of the needle valve member 32 is removed or unseated from the valve seat portion 28 of the applicator nozzle 22 thereby permitting adhesive material to be dispensed from the discharge port 26 of the applicator nozzle 22.

Figure 8:
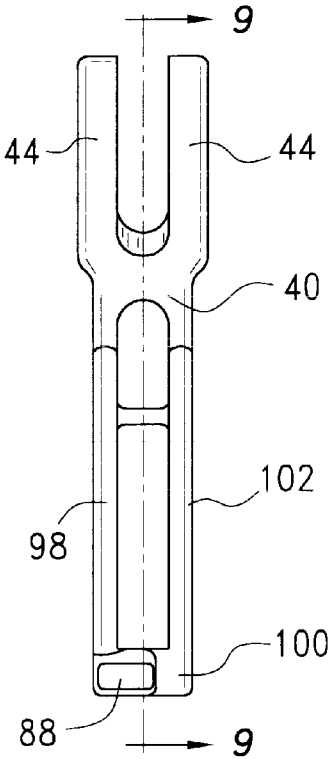
FIG. 8 is an end elevational view of the trigger member as incorporated within the hot melt adhesive applicator gun as shown in FIGS. 1–6.

With reference continuing to be made to FIG. 1, the upper rearward end portion of the applicator gun 10 comprises a needle valve actuator housing 34 within which a needle valve actuator assembly 36 is disposed, and the needle valve actuator housing 34 is seen to be integrally connected to a downwardly extending handle housing 38. A trigger member 40 is pivotally mounted upon a pivot pin 42 within the needle valve actuator housing 34 by means of a pair of upwardly extending, laterally spaced forked lug portions 44, as can better be appreciated from FIG. 8, and the needle valve actuator housing 34 also has an upstanding hanger bracket 46 fixedly mounted therein by means of which the applicator gun 10 can be supported in a suspended mode when not being used. It is likewise seen that the lower base portion 48 of the handle housing 38 has a fitting or connector 50 fixedly mounted therein by means of which an electrical power cable, not shown, can be operatively connected to the applicator gun 10 so as to supply necessary electrical power thereto. The forward ends of the handle housing base portion 48 and the needle valve actuator housing 34 are integrally connected together by means of a substantially L-shaped trigger cover or trigger guard 52, and in this manner, an open space 54 is effectively defined between the trigger cover or trigger guard 52 and the handle housing 38 by means of which an operator may insert his fingers, when his hand has grasped the handle housing 38, so as to actuate the trigger member 40. As will be more fully appreciated hereinafter, the trigger member 40 is adapted to operatively actuate an electrical trigger switch mechanism 56 mounted within the handle housing 38 as well as to actuate the needle valve member 32, so as to remove or unseat the same from its valve seat portion 28 when dispensing of the adhesive material is to be achieved, in accordance with a two-step mode of operation. It is noted that the trigger member 40 comprises a two-finger trigger member by means of which the operator's upper two fingers can operate the trigger member 40 while the operator's lower two fingers, excluding the thumb, can comfortably rest upon and be supported by means of an insert or filler member 58 fixedly mounted upon the handle housing 38. Alternatively, however, the trigger member can comprise a four-finger trigger member thereby rendering the provision of the insert or filler member 58 unnecessary. In either case, regardless of whether a two-finger trigger member or a four-finger trigger member is being used, the operative structure of the trigger member, particularly those portions thereof which are utilized to actuate both the needle valve member 32 and the electrical trigger switch mechanism 56 in accordance with the two-step mode of operation, are the same.

Figure 2:
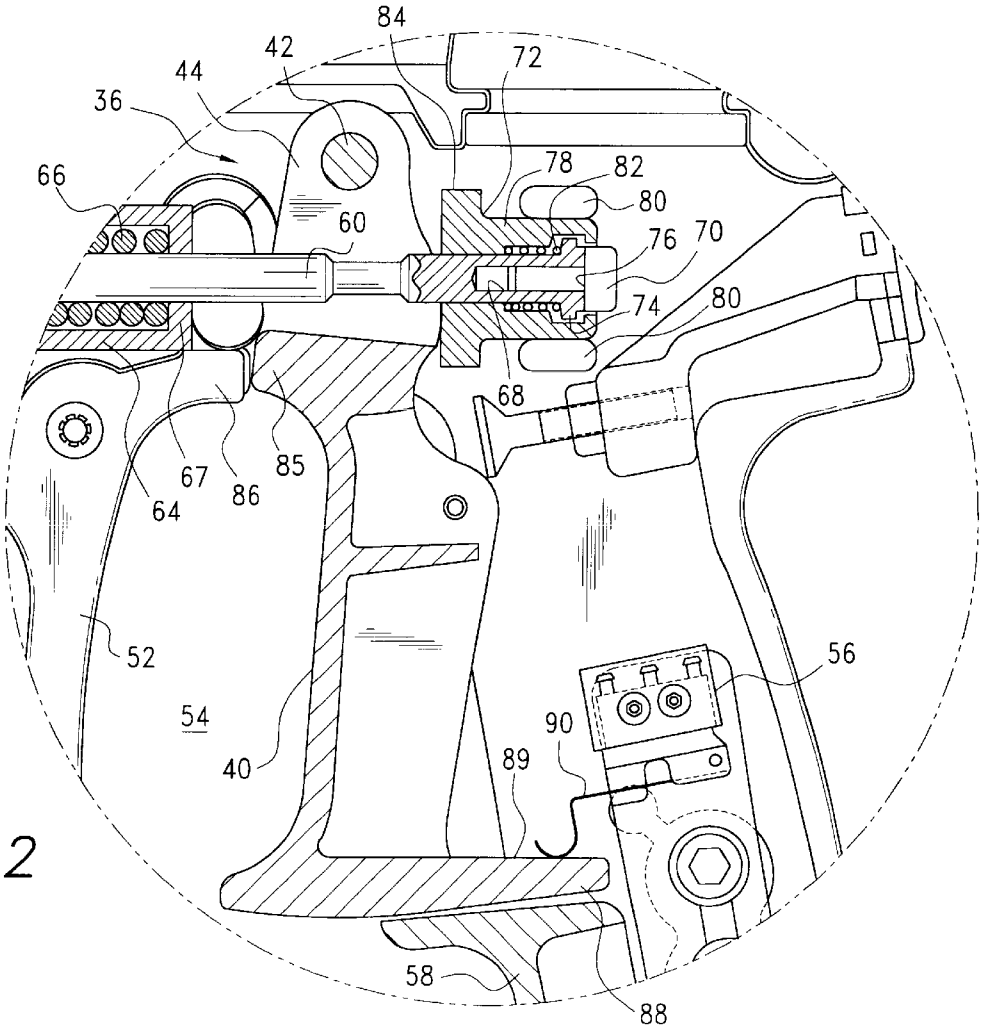
FIG. 2 is an enlarged detailed view of the circled area A of FIG. 1.

With reference continuing to be made to FIG. 1, it is further appreciated that the needle valve member 32 is integrally connected to a rearwardly disposed shank member 60 through means of a radially enlarged flanged member 62, and it is seen that the radially enlarged flanged member 62 and a forward end portion of the shank member 60 are disposed within a needle valve return compression spring housing 64 within which a needle valve return compression spring 66 is located, as might also be better seen from FIG. 2. The forward end of the needle valve return compression spring 66 is thus engaged with the flanged member 62 while the rear end of the needle valve return compression spring 66 is engaged with an end wall 67 of the needle valve return compression spring housing 64. A rear end portion of the shank member 60 is provided with an internally threaded blind bore 68 within which an externally threaded cap screw 70 is threadedly engaged. A needle valve pull sleeve or collar 72 is slidably mounted upon the rear end portion of the shank member 60, and a needle valve pull collar retainer 74, as well as a lockwasher 76, are interposed between the head of the cap screw 70 and the open end of the blind bore 68 of the shank member 60 such that when the cap screw 70 is threadedly engaged within the blind bore 68 of the shank member 60, the needle valve pull collar retainer 74 and the lockwasher 76 are fixedly mounted upon the shank member 60.

The needle valve pull collar 72 is seen to further comprise an axially extending body portion 78 wherein the external peripheral surface portion thereof is mounted for slidable guided movement within a pair of guide blocks 80, 80 fixedly mounted within the actuator housing 34, while the internal peripheral surface portion thereof is counterbored so as to house a needle valve pull collar preload compression spring 82. The forward end portion of the preload compression spring 82 engages the end wall of the counterbored portion of the needle valve pull collar body portion 78, while the rear end portion of the preload compression spring 82 engages the needle valve pull collar retainer 74. In this manner, the needle valve pull collar 72 is biased toward the left or in the forward direction as viewed in FIG. 2 such that a head portion 84 of the needle valve pull collar 72 is always disposed in abutment with the forked lug portions 44, 44 of the trigger member 40.

As a result of the aforenoted abutment or engagement contact defined between the head portion 84 of the needle valve pull collar 72 and the lug portions 44 of the trigger member 40, the trigger member 40 is rotationally biased around its pivot pin 42 in the clockwise direction such that an upper end portion 85 thereof is disposed in abutment with a forward trigger stop member 86 which is defined by means of an integral part of the upper end portion of the trigger cover or guard 52 and is effectively part of the valve actuator housing 34. In this manner, when the trigger member 40 is normally disposed at its rest position as a result of not being actuated by means of an operator, the trigger member 40 is disposed at its forward stop position against forward trigger stop member 86. It is also seen that the trigger member 40 is provided, at the lower end portion thereof, with an integral, rearwardly extending cam finger portion 88, and that the cam finger portion 88 has an upper cam surface portion 89 which is adapted to always be engaged with a spring finger, cantilever type electrical switch contact member 90 of the electrical trigger switch mechanism 56. In connection with such a structural arrangement, it is therefore to be appreciated that when the trigger member 40 is disposed at its normal, rest, non-actuated position as shown in FIG. 2, the cam finger portion 88 of the trigger member 40 is disposed in engaged contact with the electrical switch contact member 90 of the electrical trigger switch mechanism 56, however, the electrical switch contact member 90 has not been moved sufficiently upwardly so as to in turn activate the electrical trigger switch mechanism 56. Accordingly, the electrical trigger switch mechanism 56 is, at this point in time, disposed in its OPENED state.

Figure 3:
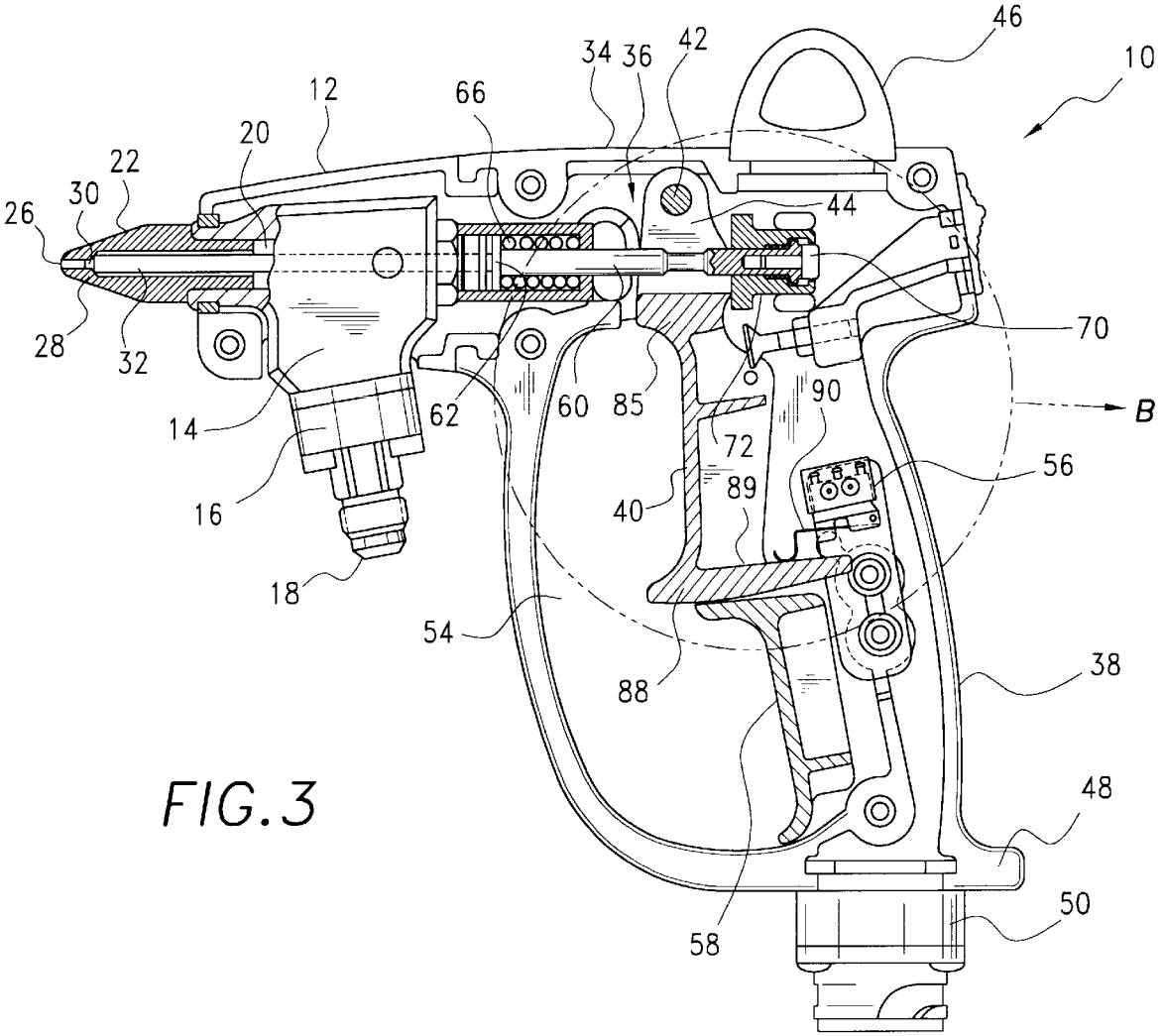
FIG. 3 is a side elevational view, partially in cross-section, similar to that of FIG. 1 showing, however, the trigger member being disposed in an actuated state where the trigger member has been moved to its first step position at which the trigger member has actuated the electrical switch element, however, the needle valve member is still disposed upon the needle valve seat.
Figure 4:
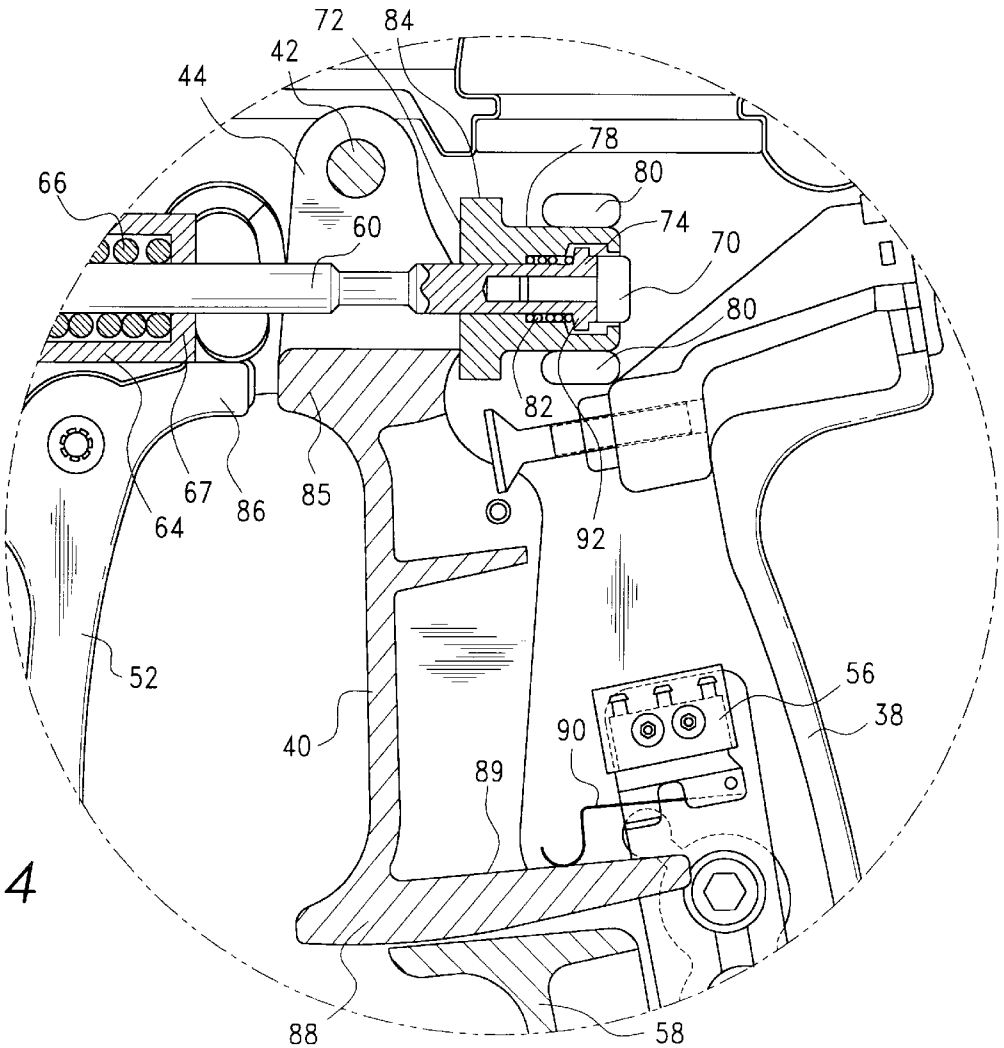
FIG. 4 is an enlarged detailed view, similar to that of FIG. 2, showing, however, the details of the circled area B of FIG. 3.

Having now described substantially all of the operationally pertinent structural components or elements of the new and improved adhesive material applicator gun 10, the operation of the same, in accordance with the aforenoted two-step actuation procedure, will now be described. As has been noted in conjunction with the detailed description of the applicator gun 10 as disclosed within FIGS. 1 and 2, when the applicator gun 10 is disposed at rest in a non-actuated state, the needle valve member 32 will have its tip portion 30 seated upon its valve seat 28 as a result of or due to the biasing force of the needle valve return compression spring 66 acting upon the radially enlarged flanged portion 62 of the needle valve assembly, as well as the disposition of the trigger member 40 at its rest position so as not to cause the needle valve member 32 to be moved to the right, as viewed in FIGS. 1 and 2, as will become more apparent hereinafter. Subsequently, when an adhesive material dispensing operation is to be initiated, the trigger member 40 is actuated so as to be depressed or squeezed whereby the trigger member 40 will be moved in the counterclockwise direction around its pivot pin 42. As a result of such pivotal movement of the trigger member 40, the various structural elements or components of the applicator gun 10 will be disposed at their respective positions, as illustrated within FIGS. 3 and 4, which comprise the first actuation step of the two-step actuation procedure. More particularly, it is seen that the trigger member 40 has been effectively moved from its first normal rest position to a second intermediate position at which the upper end portion 85 thereof has been moved away from the forward trigger stop member 86, and as a result of the engaged abutment of the forked lug members 44, 44 with the head portion 84 of the needle valve pull collar 72, the needle valve pull collar 72 is forced toward the right, as viewed in FIGS. 3 and 4, against the biasing force of the needle valve pull collar preload compression spring 82 thereby axially compressing the same.

As a result of such movement of the needle valve pull collar 72, a rearward shoulder portion 92 of the counterbored section of the needle valve pull collar body portion 78 now engages the needle valve pull collar retainer 74 whereby the needle valve pull collar 72 effectively attains a needle valve pull collar stop position at which, in turn, the pivotal movement of the trigger member 40 is momentarily stopped or arrested so as to define the second intermediate position of the trigger member 40. Still further, it is to be additionally noted that as a result of the aforenoted pivotal movement of the trigger member 40 to its second intermediate position, the upper cam surface portion 89 of the cam finger portion 88 of the trigger member 40 has now moved the electrical switch contact finger 90 to an upwardly raised position at which the electrical switch contact finger 90 causes the electrical switch mechanism 56 to now be disposed in its CLOSED state. Accordingly, a first electrical circuit, not shown, controlled by means of the electrical switch mechanism 56 is now able to electrically activate, for example, a rotary gear pump, also not shown, by means of which adhesive material is supplied into the applicator gun 10 under pressurized conditions. In a similar manner, a second electrical circuit, also not shown and also controlled by means of the electrical switch mechanism 56, is able to likewise electrically activate, for example, a solenoid air valve assembly, also not shown, so as to provide swirl air to interact with the dispensed adhesive material whereby predetermined deposition patterns of the dispensed adhesive material can be achieved. It is lastly noted that at this point in time, the needle valve member 32 has its tip portion 30 still seated upon its valve seat 28 whereby the needle valve assembly is CLOSED and no dispensing of adhesive material occurs.

Accordingly, in accordance with the principles and teachings of the present invention, it is seen that the adhesive material to be dispensed is initially supplied to the applicator gun 10 in a pressurized state, and that swirl air is also provided for interacting with the adhesive material, when the adhesive material is being dispensed so as to define or control the dispensing of the adhesive material in accordance with predetermined dispensing or deposition patterns, prior to the unseating of the tip portion 30 of the needle valve member from the needle valve seat 28. In this manner, when the tip portion 30 of the needle valve member is in fact unseated from the needle valve seat 28 so as to permit dispensing of the adhesive material, the adhesive material is already fully pressurized and the swirl air is fully operative in connection with the dispensed adhesive material. If this was not the case, if this sequence of operation was not in fact achieved, then the initial deposition of the adhesive material would not in effect constitute a full or complete charge, and the deposition pattern of the adhesive material would not be as desirably predetermined.

Figure 5:
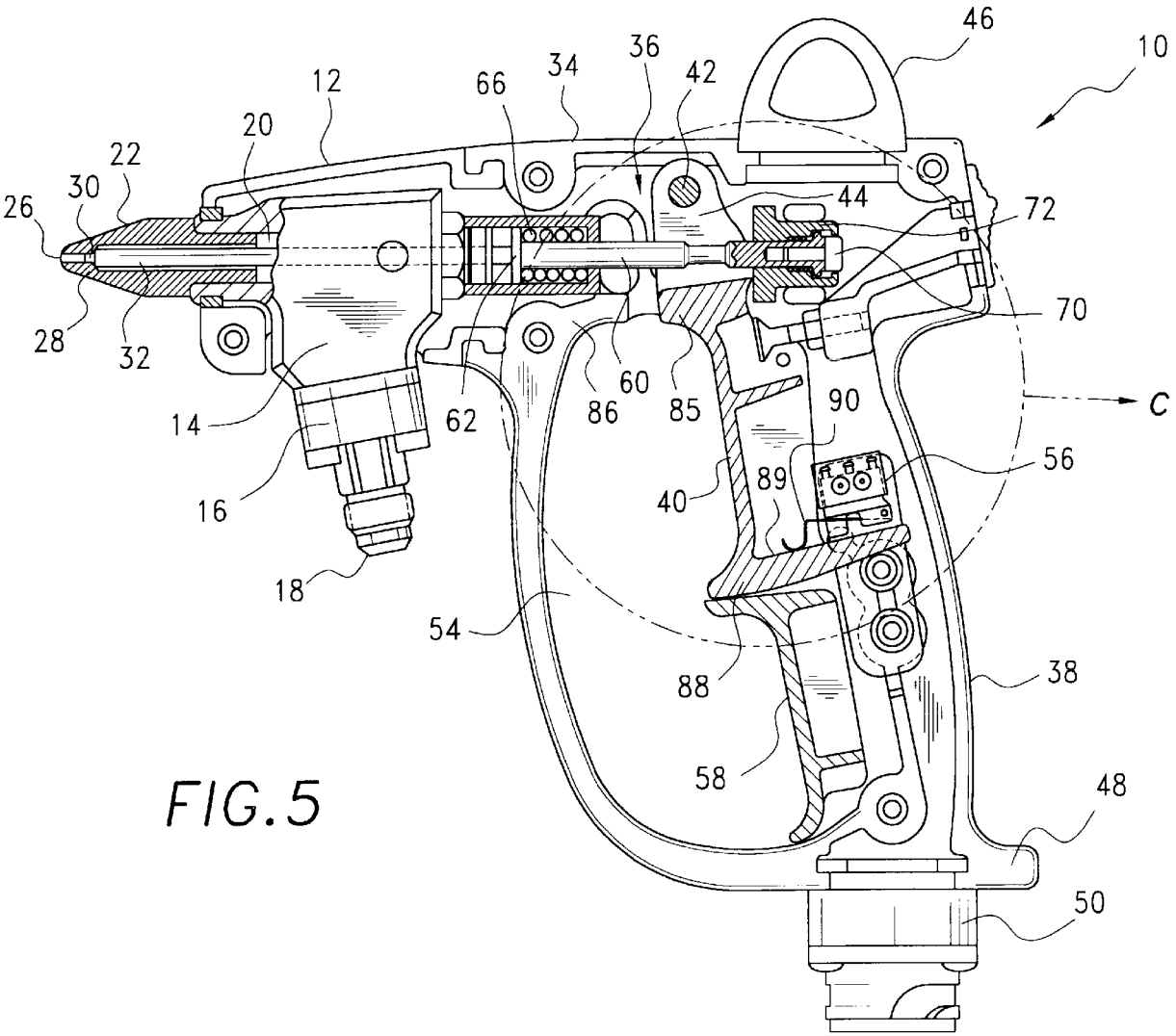
FIG. 5 is a side elevational view, partially in cross-section, similar to that of FIGS. 1 and 3 showing, however, the trigger member being disposed in an actuated state where the trigger member has been moved to its second step position at which the trigger member continues to actuate the electrical switch element, however, the needle valve member has now been pulled away from or lifted off the needle valve seat.
Figure 6:
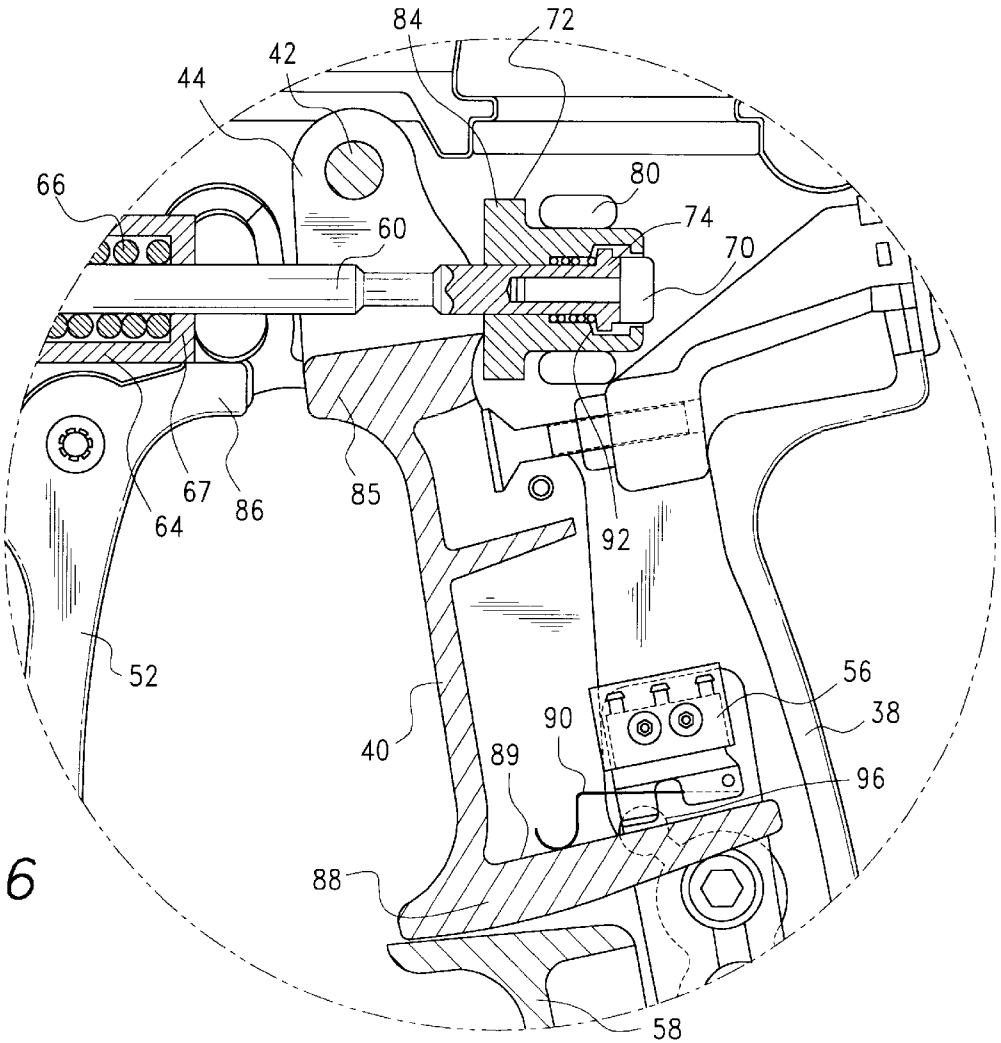
FIG. 6 is an enlarged detailed view, similar to that of FIGS. 2 and 4, showing, however, the details of the circled area C of FIG. 5.
Figure 7:
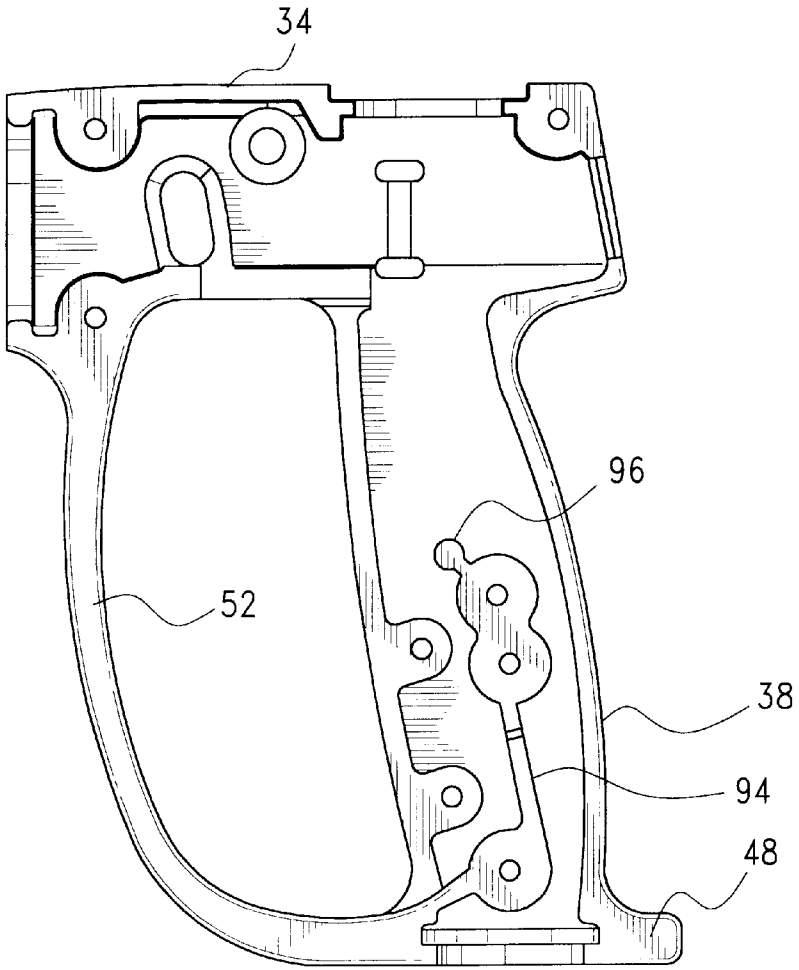
FIG. 7 is a side elevational view of one half of the handle housing assembly of the hot melt adhesive applicator gun as shown, for example, within FIGS. 1, 3 and 5, and showing the details of the trigger stop member of the handle housing assembly.

With reference now being made to FIGS. 5 and 6, when the trigger member 40 is actuated or squeezed further so as to be effectively moved from its aforenoted first actuation, second intermediate position to its second actuation or third final position, the cam finger portion 88 of the trigger member 40 will be disposed at the position illustrated in FIGS. 5 and 6 whereby the upper cam surface portion 89 of the cam finger portion 88 is still engaged with the electrical switch contact finger 90 so as to maintain the electrical switch contact finger 90 in its elevated state so as to in turn maintain the electrical switch mechanism 56 in its activated or CLOSED state whereby the aforenoted first and second electrical circuits, for respectively controlling the adhesive material supply rotary gear pump and the solenoid air valve assembly for the swirl air, are likewise maintained activated and CLOSED. In addition, the needle valve member 32 is in fact moved toward the right as viewed in FIG. 5 whereby the needle valve tip portion 30 is accordingly removed from, or unseated with respect to, its valve seat 28 such that dispensing of the adhesive material from discharge port 26 can now in fact occur. More particularly, as can best be appreciated from FIGS. 4 and 6, and as a result of the abutment conditions as respectively defined between the forked lug portions 44 of the trigger member 40 and the head portion 84 of the needle valve pull collar 72, between the shoulder portion 92 of the counterbored section of the needle valve pull collar body portion 78 of the needle valve pull collar 72 and the needle valve pull collar retainer 74, and between the needle valve pull collar retainer 74 and the head of the cap screw 70, when the trigger member 40 is in fact pivoted further in the counterclockwise direction as a result of being further actuated or squeezed, the needle valve pull collar 72 will move toward the right relative to the guide blocks 80,80 such that the needle valve pull collar 72 and the needle valve pull collar retainer 74 will effectively act upon the head of the cap screw 70 so as to force the cap screw 70 to the right. In addition, in view of the integral threaded connection between the cap screw 70 and the shank portion 60 of the needle valve member 32, the needle valve member 32 is moved to the right thereby unseating the needle valve tip portion 30 from the needle valve seat 28 whereby the adhesive material can be dispensed from the discharge port 26.

Figure 10:
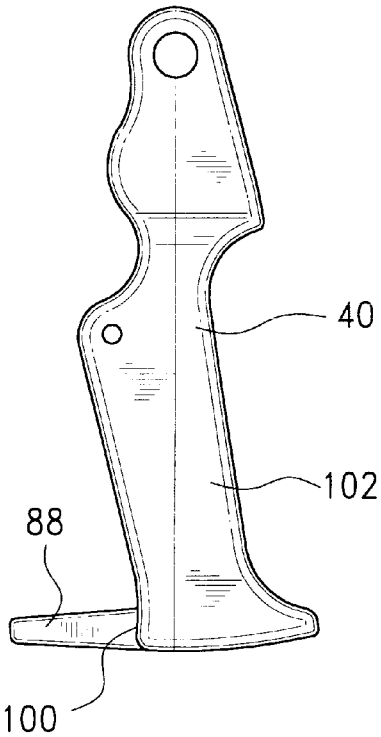
FIG. 10 is a side elevational view of the trigger member of FIG. 8 specifically showing the shoulder structure integrally formed upon the lower end portion of the trigger element for engaging the trigger stop member of the handle housing assembly as shown in FIG. 7.
Figure 9:
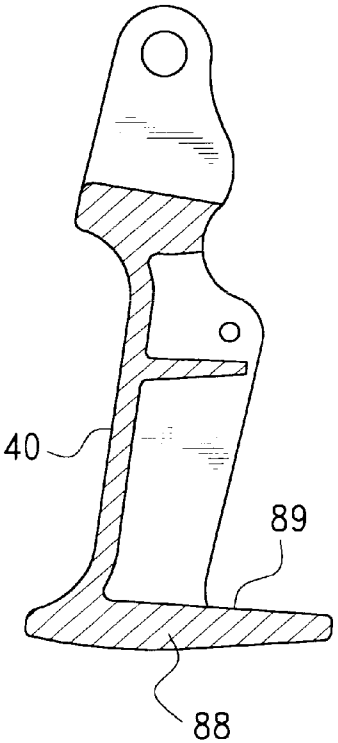
FIG. 9 is a cross-sectional view of the trigger member of FIG. 8 as taken along the lines 9—9 of FIG. 8.

It is noted further in connection with the movement of the trigger member 40 to the second actuated, third final position, as illustrated within FIGS. 5 and 6, and in a manner similar to the provision of the forward trigger stop member 86 for defining the first normal rest position for the trigger member 40, the applicator gun 10 is further provided with a rearward trigger stop member for defining the third final position for the trigger member 40. More particularly, as can best be appreciated as a result of reference being made to FIGS. 7–10, in addition to reference being made to FIGS. 5 and 6, one half-section of the trigger cover or trigger guard 52 has an upstanding support leg 94 integrally formed therewith and disposed internally within one half section of the handle housing 38, and a circular lug projection 96 is disposed atop the upstanding support leg 94. In conjunction with such structure, and as best seen from FIGS. 8–10, the cam finger portion 88 of the trigger member 40 extends rearwardly from only substantially one half section 98 of the trigger member 40 whereby a transversely disposed shoulder portion 100 is effectively defined upon the other half section 102 of the trigger member 40. Therefore, as can best be appreciated from FIG. 6, when the trigger member 40 is moved rearwardly so as to be disposed at its third, final position, the shoulder portion 100 of the trigger member 40 will engage the circular lug portion 96 whereby the lug portion 96 serves as the rearward trigger stop member thereby arresting the rearward movement of the trigger member 40 at its third, final position.

It is lastly to be appreciated that as a result of the rearward or rightward movement of the needle valve member 32 when the needle valve tip portion 30 is unseated from its valve seat 28, the radially enlarged flanged portion 62 of the needle valve member 32 also serves to axially compress the needle valve return compression spring 66 disposed within the needle valve return compression spring housing 64. Accordingly, when the trigger member 40 is released so as to effectively terminate the dispensing of the adhesive material from the discharge port 26 of the applicator nozzle 22, needle valve return spring 66 will act against the radially enlarged flanged portion 62 of the needle valve member 32 thereby biasing the same toward the left as viewed in any one of the FIGS. 1–6 whereby the needle valve tip portion 30 is again seated upon its valve seat 28. The trigger member 40 is now effectively again disposed at its second intermediate position, as disclosed in FIGS. 3 and 4, at which position it is noted that the electrical switch mechanism 56 is still disposed in its CLOSED state as a result of still being activated by means of electrical switch contact finger 90.

Accordingly, the first and second electrical circuits controlled by means of the electrical switch mechanism 56 are still disposed in their respective CLOSED states such that pressurized adhesive material and pressurized swirl air are still supplied to the applicator gun 10. This is important so as to ensure that a full and complete deposition charge of adhesive is achieved prior to complete termination of the same as a result of the seating of the needle valve tip portion 30 upon the valve seat 28, and that swirl air is maintained active so as to ensure that the air passages operatively associated with the applicator nozzle 22 are maintained clear. As the trigger member 40 is released still further back to its first relaxed or rest position as disclosed within FIGS. 1 and 2, the needle valve pull collar preload compression spring 82 will axially expand so as to bias needle valve pull collar 72 and the trigger member 40 toward the left as viewed, for example, within FIGS. 1 and 2, until the upper end portion 85 of the trigger member 40 again contacts the forward trigger stop member 86. The applicator gun 10 is therefore now ready for a new or subsequent adhesive deposition operation.

Thus, it may be seen that in accordance with the principles and teachings of the present invention, there has been provided a new and improved hot melt adhesive applicator gun wherein the actuated movement of the trigger member of the gun effectively occurs in two steps such that in accordance with a first operative step, an electrical switch mechanism is activated so as to in turn activate or energize a rotary gear pump for supplying pressurized adhesive material to the gun, as well as to activate or energize a solenoid air valve for supplying pressurized swirl air to the applicator gun, while in accordance with a second operative step, the needle valve member of the applicator gun is unseated with respect to its valve seat so as to permit dispensing of adhesive material from the applicator gun only after a sufficient supply of adhesive and swirl air have been supplied to the gun.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America is:

1. A hydraulic fluid dispensing gun, comprising:

a valve actuator housing;

a handle connected to said valve actuator housing;

a dispensing nozzle having a discharge port defined therein from which hydraulic fluid can be dispensed;

a valve seat defined within said dispensing nozzle;

a valve member;

valve actuator means disposed within said valve actuator housing for moving said valve member between a first position at which said valve member is seated upon said valve seat so as to prevent hydraulic fluid from being transmitted to said discharge port of said dispensing nozzle, and a second position at which said valve member is unseated from said valve seat so as to permit hydraulic fluid to be transmitted to said discharge port of said dispensing nozzle;

an electrical switch mechanism for controlling a hydraulic fluid supply means for supplying hydraulic fluid to said applicator gun; and a trigger member mounted upon said handle, operatively connected to said valve actuator means, and directly engaged with said electrical switch mechanism for actuating said electrical switch mechanism prior to the actuation of said valve actuator means to such an extent that said valve actuator means causes said valve member to be unseated from said valve seat such that when said valve actuator means causes said valve member to be unseated from said valve seat, a sufficient supply of the hydraulic fluid is already supplied to said dispensing nozzle.

2. The dispensing gun as set forth in claim 1, wherein:

said trigger member is movably mounted upon said handle housing between three different positions wherein, when said trigger member is disposed at a first one of said three positions, said electrical switch mechanism is disposed in an OPENED state and said valve member is seated upon said valve seat, when said trigger member is disposed at a second one of said three positions, said electrical switch mechanism is disposed in a CLOSED state and said valve member is still seated upon said valve seat, and when said trigger member is disposed at a third one of said three positions, said electrical switch mechanism is still disposed in said CLOSED state and said valve member is unseated from said valve seat.

3. The dispensing gun as set forth in claim 2, wherein:

said electrical switch mechanism comprises an electrical switch contact member; and said trigger member comprises a cam finger member for engagement with said electrical switch contact member so as to move said electrical switch contact member from a deactivated state when said trigger member is disposed at said first position to an activated state when said trigger member is disposed at said second and third positions.

4. The dispensing gun as set forth in claim 2, further comprising:

a first trigger stop member disposed upon said valve actuator housing for arresting the positional movement of said trigger member at said first position; and a second trigger stop member disposed upon said handle for arresting the positional movement of said trigger member at said third position.

5. The dispensing gun as set forth in claim 1, wherein:

said valve member comprises a radially enlarged flanged portion; and said valve actuator means comprises a spring member disposed in contact with said radially enlarged flanged portion of said valve member for normally biasing said valve member in a first direction whereby said valve member is seated upon said valve seat, and a pull collar mounted upon said valve member and disposed in contact with said trigger member such that when said trigger member is moved from said second position to said third position, said pull collar will pull said valve member in a second direction, opposite to said first direction, so as to unseat said valve member from said valve seat.

6. A hot melt adhesive material dispensing gun, comprising:

a valve actuator housing;

a handle connected to said valve actuator housing;

a dispensing nozzle having a discharge port defined therein from which hot melt adhesive material can be dispensed;

a valve seat defined within said dispensing nozzle;

a valve member;

valve actuator means disposed within said valve actuator housing for moving said valve member between a first position at which said valve member is seated upon said valve seat so as to prevent hot melt adhesive material from being transmitted to said discharge port of said dispensing nozzle, and a second position at which said valve member is unseated from said valve seat so as to permit hot melt adhesive material to be transmitted to said discharge port of said dispensing nozzle;

an electrical switch mechanism for controlling a hot melt adhesive material supply means for supplying hot melt adhesive material to said applicator gun, and swirl air means for supplying swirl air for interaction with the hot melt adhesive material; and a trigger member mounted upon said handle, operatively connected to said valve actuator means, and directly engaged with said electrical switch mechanism for actuating said electrical switch mechanism prior to the actuation of said valve actuator means to such an extent that said valve actuator means causes said valve member to be unseated from said valve seat such that when said valve actuator means causes said valve member to be unseated from said valve seat, a sufficient supply of the hot melt adhesive material and the swirl air is already supplied to said dispensing nozzle.

7. The dispensing gun as set forth in claim 6, wherein:

said trigger member is movably mounted upon said handle housing between three different positions wherein, when said trigger member is disposed at a first one of said three positions, said electrical switch mechanism is disposed in an OPENED state and said valve member is seated upon said valve seat, when said trigger member is disposed at a second one of said three positions, said electrical switch mechanism is disposed in a CLOSED state and said valve member is still seated upon said valve seat, and when said trigger member is disposed at a third one of said three positions, said electrical switch mechanism is still disposed in said CLOSED state and said valve member is unseated from said valve seat.

8. The dispensing gun as set forth in claim 7, wherein:

said electrical switch mechanism comprises an electrical switch contact member; and said trigger member comprises a cam finger member for engagement with said electrical switch contact member so as to move said electrical switch contact member from a deactivated state when said trigger member is disposed at said first position to an activated state when said trigger member is disposed at said second and third positions.

9. The dispensing gun as set forth in claim 7, further comprising:

a first trigger stop member disposed upon said valve actuator housing for arresting the positional movement of said trigger member at said first position; and a second trigger stop member disposed upon said handle for arresting the positional movement of said trigger member at said third position.

10. The dispensing gun as set forth in claim 6, wherein:

said valve member comprises a radially enlarged flanged portion; and said valve actuator means comprises a spring member disposed in contact with said radially enlarged flanged portion of said valve member for normally biasing said valve member in a first direction whereby said valve member is seated upon said valve seat, and a pull collar mounted upon said valve member and disposed in contact with said trigger member such that when said trigger member is moved from said second position to said third position, said pull collar will pull said valve member in a second direction, opposite to said first direction, so as to unseat said valve member from said valve seat.

11. A method of operating a hydraulic fluid dispensing gun, comprising the steps of:

providing a dispensing nozzle, having a discharge port defined therein and from which hydraulic fluid can be dispensed, upon said dispensing gun;

providing a valve seat within said dispensing nozzle;

providing a valve member;

providing a valve actuator for moving said valve member between a first position at which said valve member is seated upon said valve seat so as to prevent hydraulic fluid from being transmitted to said discharge port of said dispensing nozzle, and a second position at which said valve member is unseated from said valve seat so as to permit hydraulic fluid to be transmitted to said discharge port of said dispensing nozzle;

providing an electrical switch mechanism for controlling a hydraulic fluid supply means for supplying hydraulic fluid to said applicator gun; and operatively connecting a trigger member to said valve actuator and engaging said trigger member directly with said electrical switch mechanism for actuating said electrical switch mechanism prior to the actuation of said valve actuator to such an extent that said valve actuator causes said valve member to be unseated from said valve seat such that when said valve actuator causes said valve member to be unseated from said valve seat, a sufficient supply of the hydraulic fluid is already supplied to said dispensing nozzle.

12. The method as set forth in claim 11, further comprising the step of:

movably mounting said trigger member between three different positions wherein, when said trigger member is disposed at a first one of said three positions, said electrical switch mechanism is disposed in an OPENED state and said valve member is seated upon said valve seat, when said trigger member is disposed at a second one of said three positions, said electrical switch mechanism is disposed in a CLOSED state and said valve member is still seated upon said valve seat, and when said trigger member is disposed at a third one of said three positions, said electrical switch mechanism is still disposed in said CLOSED state and said valve member is unseated from said valve seat.

13. The method as set forth in claim 12, further comprising the steps of:

providing said electrical switch mechanism with an electrical switch contact member; and providing said trigger member with a cam finger member for engagement with said electrical switch contact member so as to move said electrical switch contact member from a deactivated state when said trigger member is disposed at said first position to an activated state when said trigger member is disposed at said second and third positions.

14. The method as set forth in claim 12, further comprising the steps of:

providing a first trigger stop member for arresting the positional movement of said trigger member at said first position; and providing a second trigger stop member for arresting the positional movement of said trigger member at said third position.

15. The method as set forth in claim 11, further comprising the steps of:

providing said valve member with a radially enlarged flanged portion;

disposing a spring member in contact with said radially enlarged flanged portion of said valve member for normally biasing said valve member in a first direction whereby said valve member is seated upon said valve seat; and providing a pull collar upon said valve member and in contact with said trigger member such that when said trigger member is moved from said second position to said third position, said pull collar will pull said valve member in a second direction, opposite to said first direction, so as to unseat said valve member from said valve seat.

16. A method of operating a hot melt adhesive material dispensing gun, comprising the steps of:

providing a dispensing nozzle, having a discharge port defined therein and from which hot melt adhesive material can be dispensed, upon said dispensing gun;

providing a valve seat within said dispensing nozzle;

providing a valve member;

providing a valve actuator for moving said valve member between a first position at which said valve member is seated upon said valve seat so as to prevent hot melt adhesive material from being transmitted to said discharge port of said dispensing nozzle, and a second position at which said valve member is unseated from said valve seat so as to permit hot melt adhesive material to be transmitted to said discharge port of said dispensing nozzle;

providing an electrical switch mechanism for controlling an adhesive material supply means for supplying adhesive material to said applicator gun, and swirl air means for supplying swirl air for interaction with the hot melt adhesive material; and operatively connecting a trigger member to said valve actuator and engaging said trigger member directly with said electrical switch mechanism for actuating said electrical switch mechanism prior to the actuation of said valve actuator to such an extent that said valve actuator causes said valve member to be unseated from said valve seat such that when said valve actuator causes said valve member to be unseated from said valve seat, a sufficient supply of the hot melt adhesive material and swirl air is already supplied to said dispensing nozzle.

17. The method as set forth in claim 16, further comprising the step of:

movably mounting said trigger member between three different positions wherein, when said trigger member is disposed at a first one of said three positions, said electrical switch mechanism is disposed in an OPENED state and said valve member is seated upon said valve seat, when said trigger member is disposed at a second one of said three positions, said electrical switch mechanism is disposed in a CLOSED state and said valve member is still seated upon said valve seat, and when said trigger member is disposed at a third one of said three positions, said electrical switch mechanism is still disposed in said CLOSED state and said valve member is unseated from said valve seat.

18. The method as set forth in claim 17, further comprising the steps of:

providing said electrical switch mechanism with an electrical switch contact member; and providing said trigger member with a cam finger member for engagement with said electrical switch contact member so as to move said electrical switch contact member from a deactivated state when said trigger member is disposed at said first position to an activated state when said trigger member is disposed at said second and third positions.

19. The method as set forth in claim 17, further comprising the steps of:

providing a first trigger stop member for arresting the positional movement of said trigger member at said first position; and providing a second trigger stop member for arresting the positional movement of said trigger member at said third position.

20. The method as set forth in claim 16, further comprising the steps of:

providing said valve member with a radially enlarged flanged portion;

disposing a spring member in contact with said radially enlarged flanged portion of said valve member for normally biasing said valve member in a first direction whereby said valve member is seated upon said valve seat; and providing a pull collar upon said valve member and in contact with said trigger member such that when said trigger member is moved from said second position to said third position, said pull collar will pull said valve member in a second direction, opposite to said first direction, so as to unseat said valve member from said valve seat.

* * * * *